United States Patent [19]

Hradecky et al.

[11] Patent Number: 4,720,924

[45] Date of Patent: Jan. 26, 1988

[54] MICROWAVE DRYING OF PHARMACEUTICAL GELATIN CAPSULES

[75] Inventors: Julien J. Hradecky; Joseph Subarsky, both of Kitchener; David C. T. Pei, Waterloo, all of Canada

[73] Assignee: R & J Engineering Corporation, Kitchener, Canada

[21] Appl. No.: 926,059

[22] Filed: Nov. 3, 1986

[51] Int. Cl.[4] ..... F26B 23/08

[52] U.S. Cl. ..... 34/1; 34/68; 34/105

[58] Field of Search ..... 34/1, 68, 104, 105; 219/10.55 R

[56] References Cited

U.S. PATENT DOCUMENTS

| | | | |
|---|---|---|---|
| 3,670,132 | 6/1972 | Kaufman, Jr. et al. . | |
| 3,699,899 | 10/1972 | Schiffmann et al. . | |
| 3,916,136 | 10/1975 | Anderson et al. . | |
| 4,419,374 | 12/1983 | Pei . | |
| 4,428,127 | 1/1984 | Grassmann | 34/1 |
| 4,441,003 | 4/1984 | Eves, II et al. . | |
| 4,513,513 | 4/1985 | Sayles . | |
| 4,609,417 | 9/1986 | Smith . | |

FOREIGN PATENT DOCUMENTS

| | | |
|---|---|---|
| 934827 | 10/1973 | Canada . |
| 1053012 | 12/1966 | United Kingdom . |

*Primary Examiner*—Larry I. Schwartz

*Attorney, Agent, or Firm*—R. Craig Armstrong

[57] ABSTRACT

A machine for the manufacture of gelatin pharmaceutical capsules is disclosed, in which microwave drying is used. The drying section of the machine has two upper tunnels and two corresponding return tunnels beneath them, through which pin bars carrying the hot moist gelatin capsule halves pass. Microwave transmitters are positioned above the upper tunnels to transmit microwave energy towards the capsule halves for drying. Inlet ducts along the outer sides of the upper tunnels supply cool, dry air which flows through apertures in the tunnel side walls and across the tunnels to an exhaust duct. The return tunnels also have a conditioned air system, supplied through ducts above the return tunnels having apertured bottom plates, for fine tuning the temperature and moisture content of the capsules prior to final processing operations.

12 Claims, 2 Drawing Figures

MICROWAVE DRYING OF PHARMACEUTICAL GELATIN CAPSULES

BACKGROUND OF THE INVENTION

This invention relates to the manufacture of pharmaceutical hard gelatin capsules, and particularly to the driving of the capsules during the manufacturing process.

In conventional hard gelatin capsule manufacturing machines, the gelatin solution is continuously gravity-fed from holding tanks into the dipping pans of a Dipper section. The level in the dipping pans is regulated and maintained at a constant level by automatic float valves. These dipping pans are hot-water jacketed and equipped with thermostatically-controlled electric heaters. The gelatin in the dipping pans is maintained at a pre-set temperature by automatic temperature controls to ensure the proper gelatin distribution. Automatic viscosity controls constantly monitor gelatin viscosity and add water to offset evaporation.

The caps and bodies of the capsules are formed on vertically oriented stainless steel mold pins, supported on what are commonly referred to as "pin bars". Each pin bar has stainless steel pins of the size of the desired capsule.

The following is a simplified description of a full cycle through a conventional hard gelatin capsule manufacturing machine.

Two sets (one with the capsule bodies, one with the capsule caps) of pin bars are lowered into the gelatin dipping pan to a level predetermined by a cam (whose size and shape depends on the size of capsules being run on the machine). Once dipped, the pin bars are slowly retracted from the gelatin and elevated to the upper drying kiln.

These two sets of pin bars are then fed into a pair of drying kiln systems each totalling some 50 to 52 feet in running length. In these kilns, the pin bars are subjected to very tightly controlled air conditions. Supply air is controlled to within $\pm 1\%$ relative humidity and temperatures of $\pm 1^0$ Celsius. Liekwise the volume rate of air in cubic feet per minute (cfm) or in cubic metres per hour ($m^3$/hr) is also tightly controlled. These close tolerances are essential so that the capsules are not subject to corrugation, brittleness, cracking and so on. If not enough moisture is removed from the capsules during the drying time dictated by the overall speed of the capsule machine, then the capsule halves enter the later operations of the machine in a too wet condition. In this case, further processing (such as stripping the capsule halves from the pin molds, cutting them to the proper lengths, and assembling the two halves to make finished capsules) is impossible. If too much moisture is removed, cracking will result.

The pin bars are first fed by a conveyor system through upper kilns with running lengths of about 26 to 28 feet (depending on the manufacturer of the capsule machine). When the pin bars reach the rear end of the upper kiln, they are pushed onto an elevator. The elevator lowers groups of pin bars into the lower kilns where further drying takes place. After passing through the lower kiln (about 24 feet in length), the drying cycle is complete and the capsules have attained the required moisture content. The pin bars now proceed to the Table section of the machine where they are properly positioned and fed one by one into the Automatic or Finisher section for final operations. This entire drying cycle takes about 36 to 45 minutes depending on the speed at which the capsule machine is being run.

When the pin bars are fed into the Automatic or Finisher section from the Table section, stripper jaws close over the pins and remove the capsule halves. As the capsule halves are being stripped from the pins, collets move forward and receive them. Rods inside the collets position the capsule halves and then the collets move back and lock. The collets then rise and rotate, while cutting knives precisely trim the capsules to the proper length and then withdraw. The trimmings are removed by vacuum in a cutting collector.

The collets containing both caps and bodies move forward and ejector rods push the capsule halves into joiner blocks. At this point the collets retract, leaving the joined capsules in the joiner blocks. The joined capsules are pushed out of the joiner blocks onto a conveyor belt which carries them out of the machine and into a container. Meanwhile, the pin bars move through a Greaser section, in which greaser heads polish the pins and apply a light film of special lubricant. This lubricant facilitates proper stripping of the capsules from the pins on the next cycle.

The pin bars then enter the Dipper section to begin the cycle once more.

The lengthy drying time and the ungainly overall length of the machine has been necessary heretofore due to the inefficient nature of conventional drying which tends to form a skin on the surface of the capsule halves. This makes it very difficult for the moisture within the capsule halves to migrate to the surface and subsequently evaporate as it absorbs heat from the air.

Because the drying cycle is about 38 to 40 minutes in the conventional capsule machine, the machine is about 40 feet in length. A shorter drying cycle would permit the machine to be shortened, which would have obvious cost and other advantages, but hitherto no satisfactory alternative drying means has been developed.

SUMMARY OF THE INVENTION

It is an object of the present invention to reduce the drying time involved in the production of hard gelatin capsules, thereby shortening the overall capsule processing time.

It is a further object of the invention to reduce the amount of energy required to achieve the optimum moisture content in the capsule halves prior to their final processing.

It is a further object of the invention to reduce the overall length of the hard gelatin capsule manufacturing machinery.

It is a further object of the invention to provide relatively lower cost and mechanical simplicity of the hard gelatin capsule machinery.

It has been determined that the most effective way to address the objects of the invention is to use microwave power to provide energy directly to the "bonded moisture" within the capsule. This energy transmitted directly to the gelatin capsule (without heating the air) penetrates the gelatin and accelerates the migration of moisture to the surface of the capsules due to, among other reasons, the rise in temperature. Moreover, with an adequate and controlled amount of absorbed energy, partial evaporation takes place within the capsules. This generates sufficient pressure to further speed up the migration of moisture to the surface of capsules. Thus, the overall drying rate is significantly increased. This allows a large reduction of the overall size of the drying chamber as well as drastically reducing the amount of energy required to dry the capsules. It has been projected that for a typical capsule the drying time can be reduced to about 8 minutes and the overall length of the machine can be reduced about 24 feet.

Microwave technology has been used in the past in, among other applications, the baking of bread, the drying of pasta, the drying and curing of foundry sand cores, and the curing of rubber.

This technology has not been employed in gelatin capsule manufacturing in the past due to; (1) perceived problems in the use of stainless steel pin bars in a microwave field (The capsule industry regards stainless steel pin bars as standard, and this is not likely to change due to the huge quantities of pin bars prevalent in the field.); (2) the perception that when passing groups of pin bars through the microwave field that they would be subjected to "hot spots" where different degrees of drying would exist on various areas of the capsules; and (3) the possibility of microwave leakage into the capsule production room.

Control over air temperature and humidity is not as important as with conventional gelatin capsule manufacturing technology, but it is still necessary in the present invention to provide a means for controlling the air temperature and the relative humidity conditions in the kilns in a manner compatible with the simultaneous application of microwave energy for fine-tuning to prevent cracking, brittleness and corrugation of the capsules.

BRIEF DESCRIPTION OF THE DRAWINGS

The preferred embodiment of the invention will now be described, by way of example only, with refence to the accompanying drawings, in which.

DETAILED DESCRIPTION OF THE PREFERRED EMBODIMENT

Figure 1:
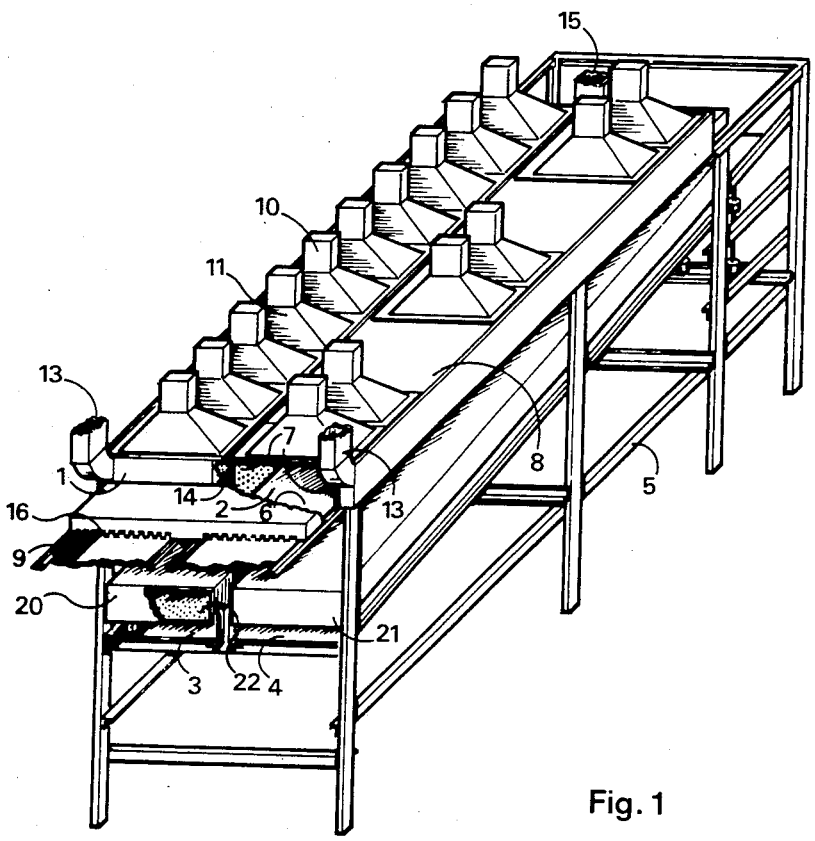
FIG. 1 is a perspective of the preferred embodiment of the apparatus, cut open to show details.

The machine of the present invention is substantially as described above, but with a much shorter drying section than in conventional machines. The preferred embodiment of the drying section, as illustrated in FIG. 1, comprises two upper tunnels 1, 2 and two corresponding lower or return tunnels 3, 4 directly beneath the upper tunnels 1, 2, all supported on a suitable frame 5.

Each of the upper tunnels 1, 2 is defined by a solid bottom rack 6, apertured side walls 7, and a top plate 8, all made of sheet metal or other suitable material.

Each of the two bottom racks 6 receives pin bars 9 from the dipping section (not shown). The pin bars 9, carrying the hot moist gelatin capsule halves, pass through the upper tunnels 1,2 in approximately 3 to 4 minutes after making a number of stops of approximately 40 to 50 seconds in duration. The pin bars are not continuously conveyed, but are pushed down the tunnels stepwise by the introduction of subsequent pin bars.

Conventional microwave transmitters, comprising magnetrons 10 and downwardly opening horns 11, are positioned above the upper tunnels 1, 2 to transmit microwave energy towards the capsule halves passing through the upper tunnels 1, 2. Apertures 12 are provided in the top plates 8 of the upper tunnels 1, 2 in order to accommodate these microwave transmitters. The magnetrons 10 are connected to a suitable conventional power supply (not shown).

Upper tunnel 1 receives pin bars 9 carrying capsule bodies, while upper tunnel 2 receives pin bars 9 carrying capsule caps.

Since the bodies of the capsules are roughly twice the length of the caps, different amounts of microwave energy are required to evaporate moisture in the cap and body sides of the machine. Therefore, there are approximately twice as many microwave transmitters on the body side, i.e. above upper tunnel 1, as on the cap side, i.e. above upper tunnel 2. It is however possible to change either the configuration of the cap side or the body side by changing the number, placement, and/or output of the transmitters. The number and position of microwave transmitters illustrated in FIG. 1 is shown only as one example.

Figure 2:
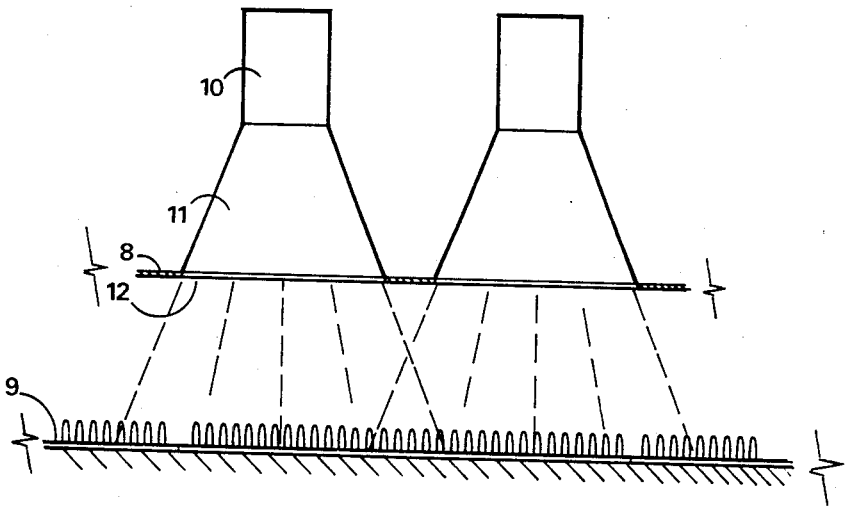
FIG. 2 is a side view, showing overlapping energy cones.

As shown in FIG. 2, the microwave transmitters preferably are arranged such that the emitted microwave energy overlaps by roughly 10 percent or more to avoid "cold spots." Their height above the pin bars 9 is approximately 25 centimeters or 10 inches in order to achieve an even distribution over the capsule halves. Different configurations are of course possible, by employing different numbers of microwave transmitters and a different design of distribution of microwave power.

It should be clearly understood, however, that it is not strictly essential to the invention that the capsule halves pass through more than one microwave transmitter each, though it is certainly preferable and more effective to have more than one.

An airstream is still required, to carry away evaporated moisture. For this purpose, inlet ducts 13 along the outer sides of the upper tunnels 1, 2 supply cool, dry air from a standard industrial type air conditioning and dehumidification system, typically at around 21 degrees Celsius and 40 percent relative humidity. A space between the upper tunnels 1, 2, constitutes an exhaust duct 14. The air enters the inlet ducts 13 near the front end of the upper tunnels 1, 2, passes laterally through the upper tunnels 1, 2 via the apertures in the side walls 7, into the exhaust duct 14, and out of the exhaust 15 near the rear end of upper tunnel 1, 2, via the apertures in the side walls 7, into the exhaust duct 14, and out the exhaust 15 near the rear end of the upper tunnels 1, 2. Passing the air through laterally instead of longitudinally ensures that the air passing around the capsules in the tunnel does not become saturated and thus unable to carry away moisture evaporated from the capsules.

The purpose of this air is to carry away the moisture evaporated from the capsules by the microwaves, rather than to carry out drying, though of course some limited drying action from the airstream is unavoidable, and there is no reason to avoid it. However, since the drying is accomplished by the microwaves, there is no need for the expensive and wasteful energy input required to heat the airstream, as is the case in conventional machines where the drying action arises solely from the airstream.

The pin bars 9 reach the end of the upper tunnels 1, 2 in about 3 to 4 minutes. At the end of the upper tunnels 1, 2, there is an elevator assembly, similar to the assembly in conventional machines and therefore not shown in detail, which is triggered automatically to lower the pin bars 9 coming out of the upper tunnels 1, 2 and push them into the lower or return tunnels 3, 4. The capsules are essentially dry by the time they reach the return tunnels 3, 4, and thus there is no microwave drying in the return tunnels 3, 4. The return tunnels 3, 4 do have a conditioned air system, supplied for example through ducts 20, 21 above return tunnels 3, 4 having apertured bottom plates 22. This conditioned air system, which may be of any other suitable structure, is used for fine tuning to adjust the temperature of the pin bars, which are warm from the hot gelatin, and to make any necessary minor adjustments in the moisture content of the capsules prior to the final processing operations.

Since capsule drying is a continuous process and the pin bars must enter and exit a microwave field which is not turned on and off, the drying chambers must be constructed such that any microwave radiation leakage is attenuated, according to prevailing safety standards and government regulations. For this reason, and to prevent undesireable attenuation, the apertures in the side walls 7 preferably are small enough to prevent passage of the microwave. Similarly, at each end of the chambers through which the pin bars pass, there is incorporated a comb shaped barrier 16 such that when the pin bar does pass through, the gap between the pins and the barrier will be of the magnitude to stop propagation of the microwave wavelength. This comb shaped barrier 16 will be interchangeable such that optimum attentuation of microwave leakage is achieved when any size of pin bars are being run on the capsule machine. In both cases, the microwave energy will "see" these perforations or slits as solid walls, thus preventing their leakage into the capsule production room.

It must be appreciated that the area around where the pin bars 9 enter and exit the upper tunnels 1, 2 is enclosed within the machine as a whole, so that any minor leakage out the ends of the upper tunnels 1, 2 is largely contained within the machine as a whole. In any event, most of the energy is absorbed by the capsule halves on the pin bars 9.

Whatever shielding or labyrinth arrangement is used in any given installation is of course subject to considerable designer discretion. It is the responsibility of anyone practising the invention to ensure that adequate safety precautions are employed, as is the case with any microwave facility. The specific precautions are not part of this invention.

The microwave frequency employed is an ordinary design choice. Suitable microwave frequencies presently considered for this application are 915 MHz and 2450 MHz, although any other suitable frequency could be employed.

As to the power level of the microwaves, this is readily calculated, with no need for special expertise, since the number of pins in the chamber at any given time, the moisture content of the capsule halves on the pins, and their speed through the machine is known. Thus the rate at which the water must be evaporated can be calculated, as well as the total energy input required to do so. The calculation determines the approximate power required, and then the final power input is determined empirically, by careful monitoring and sampling, and adjustment of the power level based on the moisture content of the samples.

The power level of the microwaves may be constant along the upper tunnels 1, 2, or may be set to gradually reduce along the length of the tunnels for more economical drying.

The advantages of the invention may be summarized as follows:

It is anticipated that significant energy savings can be realized with the microwave drying system. The climate control energy requirements for a capsule producer's factory could potentially be reduced by as much as one half in some cases. Not only is the capital cost of climate control equipment significantly reduced, but also the operating costs are significantly reduced. For example, with the microwave system in a factory currently requiring about 125 tons of air conditioning, it is projected that possibly only about 50 tons may be required. This alone would represent enormous energy savings. In addition, the heat added by the machine to dry the capsules may be reduced by as much as one third. Currently about 22–24 kw of heat typically are applied to the capsules for each machine during the drying cycle. During a 24 hour production process, on each of four machines in a typical capsule factory, this would represent approximately 210,000 kwh over a year only in added heat. With the microwave drying system this could conceivably be reduced to possibly as little as about 140,000 kwh over a year. Thus with possibly only half the energy required for climate control and possibly only two-thirds the energy required for added heat, a capsule machine using the microwave drying system is extremely marketable on energy savings alone. In addition, roughly only half of the production room space is required in comparison with conventional machines. Thus the user's capital costs as well as operating costs for climate control will again be significantly reduced.

Other benefits may include an improved finished product as the drying process for the capsule may be more even, with the drying taking place from the inside of the capsule to the outside. It is also expected that increased productivity in capsule production will be realized as experience with the microwave drying system grows. Operating costs will also be significantly reduced for the machine user, since the microwave transmitters (megatrons) can be replaced at very nominal costs during routine maintenance.

What is claimed as the invention is:

1. In a capsule manufacturing machine in which pin bars carrying wet gelatin capsule halves on metal pins projecting from said pin bars pass through a drying tunnel in which temperature and humidity conditions are controlled, the improvement comprising at least one microwave transmitter disposed adjacent at least a portion of said drying tunnel for radiating said pin bars in said tunnel to dry said gelatin capsule halves.

2. A capsule manufacturing machine as recited in claim 1, further including air supply means communicating with said drying tunnel for passing relatively cool, dry air through said tunnel in the region of said portion of said drying tunnel adjacent to said at least one microwave transmitter.

3. A capsule manufacturing machine as recited in claim 2, in which said air supply means passes said relatively cool, dry air through said portion of said drying tunnel laterally.

4. A capsule manufacturing machine as recited in claim 1, in which said at least one microwave transmitter is disposed adjacent only a first portion of said tunnel, and in which a subsequent portion of said tunnel includes drying means other than microwave drying means.

5. A capsule manufacturing machine as recited in claim 4, further including air supply means communicating with said drying tunnel for passing relatively cool, dry air through said tunnel in the region of said portion of said drying tunnel adjacent to said at least one microwave transmitter.

6. A capsule manufacturing machine as recited in claim 5, in which said air supply means passes said relatively cool, dry air through said portion of said drying tunnel laterally.

7. A capsule manufacturing machine as recited in claim 1, comprising at least two said microwave transmitters, said microwave transmitters being arranged so as to have the cones of their radiated energy substantially overlapping each other in the region of said pin bars. thereby producing a more even energy distribution.

8. A capsule manufacturing machine as recited in claim 7, further including air supply means communicating with said drying tunnel for passing relatively cool, dry air through said tunnel in the region of said portion of said drying tunnel adjacent to said at least one microwave transmitter.

9. A capsule manufacturing machine as recited in claim 8, in which said air supply means passes said relatively cool, dry air through said portion of said drying tunnel laterally.

10. A capsule manufacturing machine as recited in claim 7, in which said at least one microwave transmitter is disposed adjacent only a first portion of said tunnel, and in which a subsequent portion of said tunnel includes drying means other then microwave drying means.

11. A capsule manufacturing machine as recited in claim 10, further including air supply means communicating with said drying tunnel for passing relatively cool, dry air through said tunnel in the region of said portion of said drying tunnel adjacent to said at least one microwave transmitter.

12. A capsule manufacturing machine as recited in claim 11, in which said air supply means passes said relatively cool, dry air through said portion of said drying tunnel laterally.

* * * * *